US007777601B2

(12) United States Patent
Kakisako et al.

(10) Patent No.: US 7,777,601 B2
(45) Date of Patent: Aug. 17, 2010

(54) CIRCUIT BREAKER

(75) Inventors: Hiroyuki Kakisako, Tokyo (JP); Hitoshi Ito, Tokyo (JP); Kozo Maeta, Tokyo (JP); Masanori Kawamura, Tokyo (JP); Shigeki Koumoto, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 645 days.

(21) Appl. No.: 11/658,169

(22) PCT Filed: Feb. 10, 2006

(86) PCT No.: PCT/JP2006/302342

§ 371 (c)(1),
(2), (4) Date: Jan. 23, 2007

(87) PCT Pub. No.: WO2006/114926

PCT Pub. Date: Feb. 11, 2006

(65) Prior Publication Data

US 2008/0289943 A1 Nov. 27, 2008

(30) Foreign Application Priority Data

| | | |
|---|---|---|
| Apr. 20, 2005 | (JP) | 2005-122059 |
| Nov. 22, 2005 | (JP) | 2005-337118 |
| Dec. 1, 2005 | (JP) | 2005-348018 |
| Dec. 13, 2005 | (JP) | 2005-359356 |

(51) Int. Cl.

| | |
|---|---|
| ***H01H 1/00*** | (2006.01) |
| ***H01H 75/00*** | (2006.01) |
| ***H01H 77/00*** | (2006.01) |
| ***H01H 83/00*** | (2006.01) |
| ***H01H 1/22*** | (2006.01) |

(52) U.S. Cl. ..... 335/196; 335/6; 335/15; 335/46; 335/57; 335/60; 335/83; 335/106; 335/133; 200/244; 200/248; 200/249; 200/254; 200/271; 200/272; 200/273; 200/274; 200/275; 200/401

(58) Field of Classification Search ..... 335/6, 335/12, 15, 46, 57, 60, 83, 106, 121, 133, 335/196; 200/244, 248–249, 254, 271–275, 200/401

See application file for complete search history.

(56) References Cited

U.S. PATENT DOCUMENTS 3,137,778 A * 6/1964 Barr ..... 200/259

(Continued)

FOREIGN PATENT DOCUMENTS

EP 418754 A2 * 3/1991

(Continued)

OTHER PUBLICATIONS

Japanese Office Action dated Nov. 10, 2009, corresponding to Japanese Patent Application No. 2005-122059.

(Continued)

*Primary Examiner*—Elvin G Enad
*Assistant Examiner*—Mohamad A Musleh
(74) *Attorney, Agent, or Firm*—Sughrue Mion, PLLC

(57) ABSTRACT

A movable contacting device in a circuit breaker comprises: a crossbar linked with the opening/closing mechanism and carried so as to pivot cooperatively with the opening/closing mechanism; a movable contact arm engaged, so as to cooperational with the crossbar, with a shaft fitted into a mutually opposing recesses in the crossbar; and a movable contact arm support fixed to the case accomodating the opening/closing mechanism and having mutually opposing through-holes through which the shaft is passed; and the movable contact being configured so that the movable contact slides between surfaces of movable contact arm support having the mutually opposing through-holes; and the construction of a single-pole portion of the movable contact arm is constituted by arranging in parallel two movable contact arm members each having a movable contact at one end, and in a shaft-supporting portion at the other end, an elastic member is sandwiched between the two movable contact arm members. With this arrangement, circuit breakers provided with a movable contacting device that is small in size and stable in contact resistance can be made available.

11 Claims, 13 Drawing Sheets

U.S. PATENT DOCUMENTS

| | | | | | |
|---|---|---|---|---|---|
| 3,174,024 | A | * | 3/1965 | Zipay et al. | 200/244 |
| 4,890,081 | A | | 12/1989 | McKee et al. | |
| 5,004,878 | A | * | 4/1991 | Seymour et al. | 218/155 |
| 5,200,724 | A | * | 4/1993 | Gula et al. | 335/166 |
| 5,566,818 | A | | 10/1996 | Kuboyama et al. | |
| 6,534,737 | B1 | * | 3/2003 | Rademacher et al. | 200/401 |
| 6,878,890 | B1 | * | 4/2005 | Stay et al. | 200/244 |

FOREIGN PATENT DOCUMENTS

| | | | | |
|---|---|---|---|---|
| EP | 0 671 754 | B1 | | 2/1999 |
| JP | 35-11949 | Y1 | | 6/1960 |
| JP | 3-208223 | A | | 9/1991 |
| JP | 5-54786 | A | | 3/1993 |
| JP | 05-151879 | A | | 6/1993 |
| JP | 7-6681 | A | | 1/1995 |
| JP | 08129949 | A | * | 5/1996 |
| JP | 9-306326 | A | | 11/1997 |
| JP | 09-306328 | A | | 11/1997 |
| JP | 2000-268697 | A | | 9/2000 |
| JP | 3359422 | B2 | | 10/2002 |
| KR | 10-01484886 | B1 | | 5/1998 |

* cited by examiner (a)

(b)

CIRCUIT BREAKER

TECHNICAL FIELD

The present invention relates to circuit breakers such as molded-case circuit breakers and earth-leakage circuit breakers, and more particularly, to stabilization of contact resistance values in a sliding-contact method of a movable contacting device.

BACKGROUND ART

The opening/closing lifetime of the circuit breaker includes a mechanical one and an electrical one. The former depends chiefly on wear and damage of its mechanical component. Meanwhile, the latter is dominated by, in addition to those, wear and tear of contacts, normally being shorter in lifetime than the former. Regarding the damage of the mechanical component, a fatigue burnout of parts that perform electrical connections by means of a flat stranded copper wire or a sheet metal that provides flexibility (hereinafter referred to as shunt), is particularly a major cause that limits the opening/closing lifetime.

As a measure for eliminating the cause, a current-carrying mechanism is known that increases a contact pressure between a movable contact and a movable contact arm support, by slidably contacting the movable contact with the movable contact arm support, and using a compression spring placed outside the movable contact arm. The electrical contact between the movable contact and the movable contact arm support is generally referred to as "shuntless current-carrying mechanism" because the fore-mentioned shunt is not to be employed. e.g., refer to Patent Documents 1 and 2.

Patent Document 1

Japan Patent Publication H09-306326

Patent Document 2

Japan Patent Publication H07-006681

DISCLOSURE OF INVENTION

[Problem that the Invention is to Solve]

When a movable contact arm support is fixed to a case base, a movable contacting device of a conventional circuit breaker has presented a problem in that a dimension corresponding to the thickness of a movable contact easily varies, so that a contact resistance between the movable contact and the movable contact arm support becomes unstable. The movable contactor device also has had a problem in that a space required to accommodate the current-carrying mechanism will be increased, in contrast with that of a current-carrying mechanism using a shunt, due to the compression spring being placed outside the mechanism.

Of these issues, in order to stabilize the contact resistance, i.e., an integrally-formed movable contact arm support, i.e., there could be a method in which the movable contact sandwiched between mutually opposing contact surfaces of the movable contact arm support whereas the thickness measurement between the mutually opposing contact surfaces of the movable contact arm support need to be stringently controlled as well as the thickness dimension of the movable contact. The difference between these dimensions i.e., between the movable contact arm overall thickness and the dimension internally created by the mutually opposing contact surfaces of the movable contact arm support should ideally be zero. It is undeniable, however, in fact that the dimension between the mutually opposing contact surfaces of the movable contact arm support is frequently wider slightly. That, accordingly, means that the compression by the above-described compression spring makes the mutually opposing contact surfaces of the movable contact arm support come into contact with the movable contact while they are being bent. For this reason, because point contact by bending is liable to occur, the contact resistance is likely to be increased. Furthermore, the mutually opposing contact surfaces of the movable contact arm support require lean construction. As a result, there could be adverse effects in which mechanical distortion—inappropriate for high rated current circuit breakers—produced during parts processing, assembling and handling have to be prevented, i.e., the measurements of the contact arm support have to be meticulously maintained at given measurements.

The present invention has been made to solve above-described problems and the like, and an object of the invention is to obtain circuit breakers that are provided with a movable contacting device that is small in size and stable in contact resistance.

[Means for Solving the Problem]

A movable contacting device in a circuit breaker of the present invention comprises: a crossbar linked with the opening/closing mechanism and carried so as to pivot cooperatively with the opening/closing mechanism; a movable contact arm engaged, so as to be operational with the crossbar, with a shaft fitted into mutually opposing recesses in the crossbar; a movable contact arm support fixed to the case accommodating the opening/closing mechanism, and having mutually opposing through-holes through which the shaft is passed, and the movable contact arm being configured so that the movable contact arm slides between surfaces of the movable contact arm support having the mutually opposing through-holes, and the construction of a single-pole portion of the movable contact arm is constituted by arranging in parallel two movable contact arm members each having a movable contact at one end, and in a shaft-supporting portion at the other end, an elastic member is sandwiched between the two movable contact arm members.

[Effects of the Invention]

As described above, whereas the present invention pertains to the shuntless current-carrying mechanism superior to mechanically opening/closing lifetime, the circuit breaker that is provided with the movable contacting device having a high current-carrying performance, can be achieved.

REFERENCES OF NUMERALS AND SYMBOLS

"1" is an enclosure; "1*a*," an opening for an operating-handle; "2," a case base; "3," an operating handle; "4," a stationary contact arm; "6," a stationary contact; "7," a movable contact; "8," a movable contact arm; "8*a*," through-holes; "8*b*," recesses; "8*c*," contact areas; "8*s*," elongate holes; "81," a movable contact arm member; "82," a movable contact arm member; "9," a shaft; "10," a crossbar; "10*a*," a second spring anchor portion; "11," a movable contact arm support; "11*a*," a base mount; "11*b*," connecting conductors; "11*d*," second through-holes; "14," a relay conductor; "15," a load conductor; "16," an elastic member; "17," a helical spring; "18," a wave spring; "19," an anti-attraction member; "20," an anti-vibration member; "21," a spring anchor member; "21*a*," a first spring anchor portion; "22," a contact pressure extension spring; "101," a circuit breaker; and "102," an opening/closing mechanism.

BEST MODE FOR CARRYING OUT THE INVENTION

Embodiment 1

Figure 1:
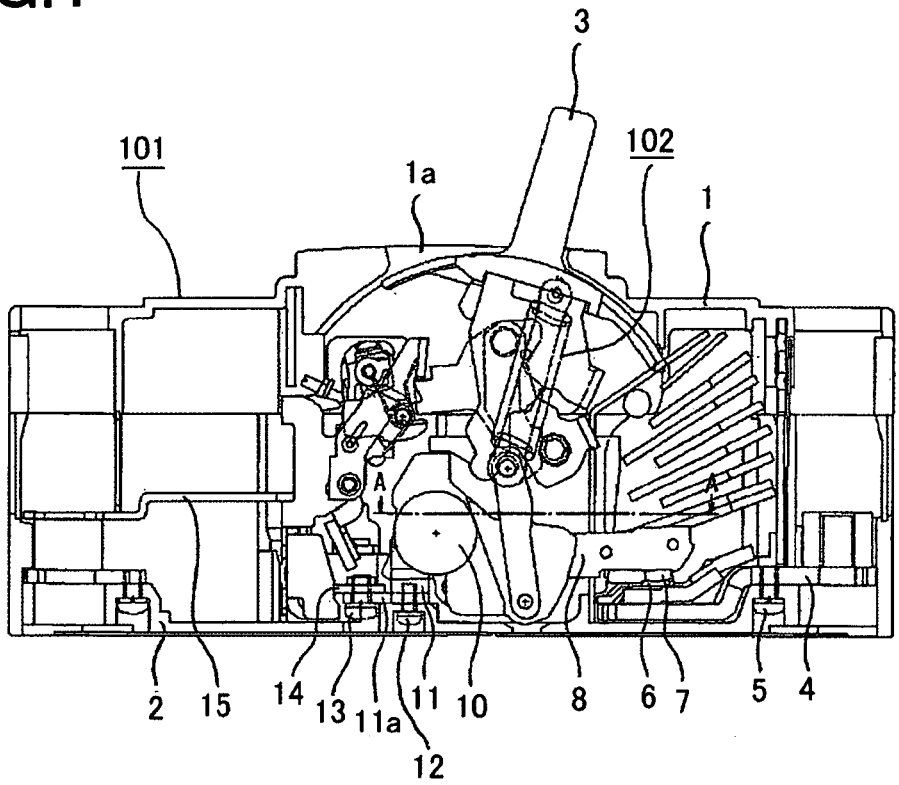
FIG. 1 is a front elevation illustrating a closing state of a circuit breaker in Embodiment 1 of the present invention.
Figure 2:
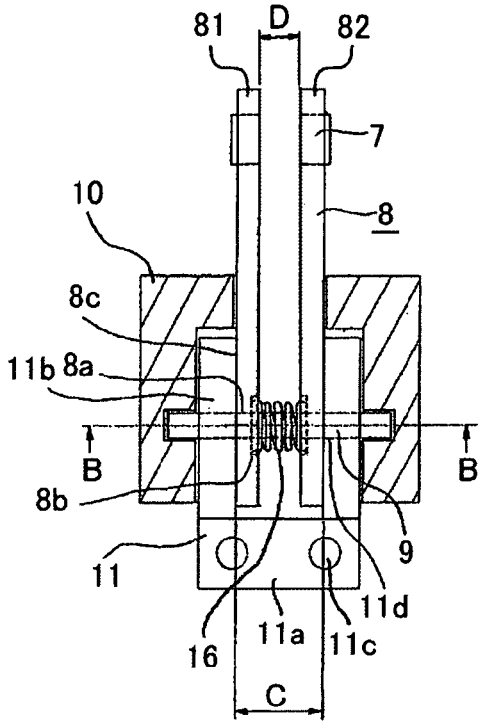
FIG. 2 is a cross-sectional view taken along Line A-A in FIG. 1.
Figure 3:
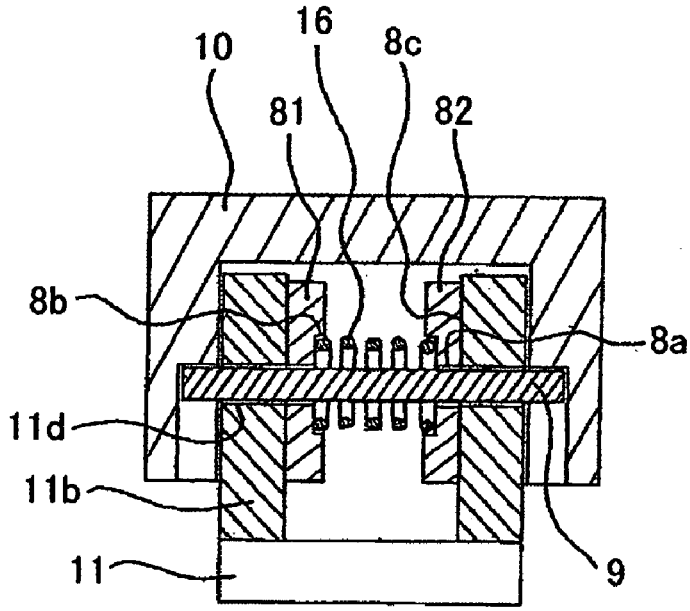
FIG. 3 is a cross-sectional view taken along Line A-A in FIG. 2.

FIG. 1 is a front elevation illustrating a closed state on of a circuit breaker in Embodiment 1 of the present invention. FIG. 2 is a cross-sectional view taken along Line A-A in FIG. 1, being doubled with a plan of a movable contacting device for single pole. In addition, FIG. 3 is a cross-sectional view taken along Line B-B in FIG. 2.

Referring to FIG. 1, an enclosure 1 and a case base 2 constitute a case for a circuit breaker 101, each being formed of synthetic resin. The case base 2 houses an opening/closing mechanism 102, an operating handle 3 that is cooperated with the opening/closing mechanism 102 protrudes outwardly from an opening 1*a* of the enclosure 1, for an operating handle 3, so that the circuit breaker is hand-operable from the outside thereof, as is known in the art. It is also well known in the art that present on the right side of the drawing with respect to the operating handle 3 position of the circuit breaker 101 being in the closed state, is, for instance, a terminal (not numerically referenced) for a power source cable, not shown, and present in the left part thereof is, e.g., a terminal (not numerically referenced) for a load cable, not shown either.

It is known in the art that by securing to the case base 2 by means of a fixing screw 5 a stationary contact arm 4 that constitutes the terminal for the power source cable, and by detaching a stationary contact 6 fixed to one end of the stationary contact arm 4, from movable contacts 7 that has been fixedly to one end of a movable contact arm 8, the circuit breaker 101 is made open and closed, i.e., an electric path is made switched on and off. By connecting the opening/closing mechanism 102 with a crossbar 10 that engages the movable contact arm 8 with a shaft 9 (refer to FIG. 2), this opening/closing operation is performed in response to the operation of the opening/closing mechanism 102. Since the opening/closing mechanism 102 does not constitute the main part of the present invention, the detailed description thereof will be omitted.

The movable contact arm 8 is inserted into a movable contact arm support 11, which in turn is fixed to the case base 2 by means of a fixing screw 12 as well as connected with a relay conductor 14 by means of a fixing screw 13. The relay conductor 14 is connected with a load conductor 15 constituting the terminal for the load cable, via a heater constituting an overcurrent release, not shown. Consequently, the current path in the closed condition is the stationary contact arm 4, the stationary contact 6, the movable contacts 7, the movable contact arm 8, the movable contact arm support 11, the relay conductor 14, the heater, and the load contactor 15, in that order. This indicates that a shuntless current-carrying mechanism without using a shunt is established. The movable contact arm 8—the core part of the shuntless current-carrying mechanism, i.e., the main part of the present invention—is inserted into the movable contact arm support 11 described previously, that is, electrical contact between the movable contact arm 8 and the movable contact arm support 11 will be described in detail as below.

Referring to FIG. 2, the movable contact arm support 11 is integrally formed with a base mount 11*a* including a screw hole, not shown, into which the fore-mentioned fixing screw 12 is threaded, and first through-holes 11*c* through each of which the fixing screw 13 is passed; and a pair of connecting conductors 11*b* including second through-holes 11*d* through which the shaft 9 is passed, that perpendicularly rises from the base mount 11*a* and has mutually opposing apical portions. On the other hand, the movable contacts 7 are fixedly mounted on one end of the movable contact arm 8, and each of through-holes 8*a* is provided on the other end thereof. With the shaft 9 being passed through the through-holes 8*a* the movable contact arm 8 is pivotally engaged with the crossbar 10. Furthermore, recesses 8*b* are provided on mutually opposing surfaces of movable contact arm members 81 and 82 arranged in parallel to constitute the movable contact arm 8, i.e., on the opposite lateral surfaces of surfaces on which the movable contact arm members 81 and 82 contact the movable contact arm support 11. A spring—an elastic member 16 loosely mounted on the shaft 9—is fitted into the recesses 8*b*. It should be noted that in Embodiment 1, the movable contact arm members 81 and 82 are provided, but the quantity is not limited to two.

Next, the assembly method will be described. The elastic member 16—so-called compression spring—is sandwiched between the movable contact arm members 81 and 82 arranged in parallel. The elastic member 16 biases the movable contact arm members 81 and 82 toward the direction in which the mutually opposing lateral surfaces of the movable contact arm members 81 and 82 abut on the pair of the connecting conductors 11*b* until the dimension between the conductors 11*b* is at least below Dimension Cas shown, and then the elastic member 16 is inserted into the connecting conductors 11*b*. Subsequently, second through-holes 11*d* and through-holes 8*a* are aligned with each other, and the shaft 9 is passed through the through-holes 11*d* and 8*a* and the elastic member 16, and then, as shown in FIG. 3, the shaft 9 is engaged into U-shaped recesses in the crossbar 10. Then, by fitting a compression spring, not shown, that applies torque to the movable contact arm 8 and thereby generates contact pressure between the stationary contact 6 (refer to FIG. 1) and the movable contacts 7, the shuntless current-carrying mechanism is constituted. The elastic member 16, therefore, allows a planar surface contact between contact areas 8*c* of the movable contact arm 8 and the conductors 11*b* to be maintained, so that contact resistance is stabilized. In addition, Dimension C in the movable contact arm support 11 does not need to be stringently managed as well as the conductors 1*b* do not need to be bent, so that the conductors 11*b* can be made thicker, reduction of the resistance value, stated another way, increase of current-carrying capacity is anticipated.

Embodiment 2

In Embodiment 1, assuming increase of the current rating based upon increase of the current-carrying capacity, a plurarity (two) of movable contact arm members 81 and 82 has been used. Another case in which increase of current rating is not anticipated, or a thick movable contact arm 8 is used will be described as Embodiment 2. Here, FIG. 4 is a view corresponding to FIG. 3 in Embodiment 2.

Figure 4:
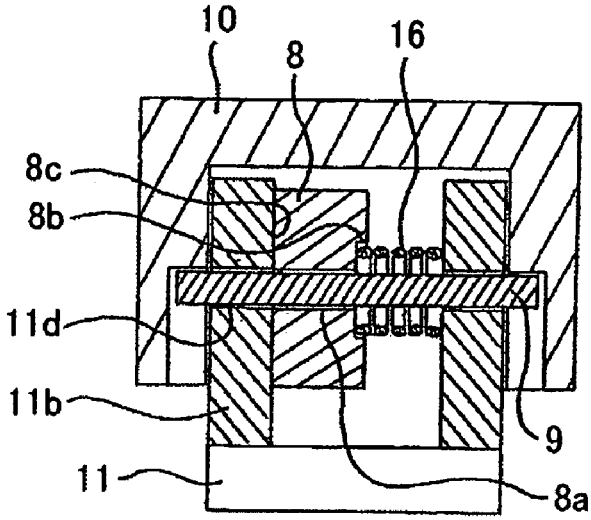
FIG. 4 is a cross-sectional view corresponding to FIG. 3 in Embodiment 2 of the present invention.

Referring to FIG. 4, recesses 8*b* are provided on the opposite lateral side of contact areas 8*c* of the movable contact arm 8. An elastic member 16 loosely mounted on a shaft 9 is inserted into the recesses 8*b*. As is the case with Embodiment 1, the elastic member 16 is a compression spring, and the movable contact arm 8 is inserted between a pair of connecting conductors 11*b* so that the elastic member 16 is sandwiched between the movable contact arm 8 and a movable contact arm support 11. Here, fitting a compression spring, not shown, and the shaft 9 is the same as that shown in Embodiment 1. Therefore, also in Embodiment 2, the elastic member 16 allows the surface contact between the contact areas of the movable contact arm 8 and the connecting conductors 11*b* to be maintained, thereby assuring stable contact resistance.

It should be noted that in Embodiment 1 and 2, the movable contact arm support 11 has been described as an integrated formation, but is not limited to this structure. It should be understood, of course, that similar effects can be acquired even when, for example, a split movable contact arm support as shown in Patent Document 1 is sandwiched between the left and right lateral sides of the drawings as shown in FIG. 3 and FIG. 4.

Embodiment 3

Figure 6:
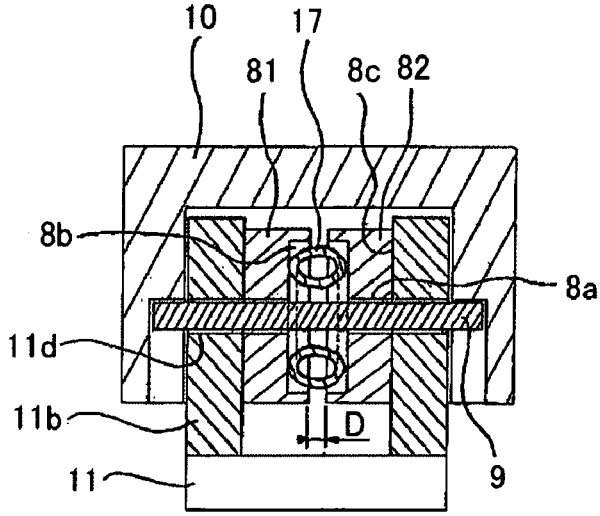
FIG. 6 is a cross-sectional view corresponding to FIG. 3 in Embodiment 3 of the present invention.
Figure 7:
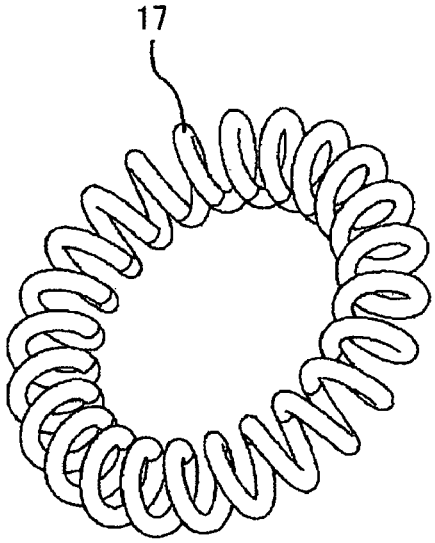
FIG. 7 is an outline perspective view of a coil spring in Embodiment 3 of the present invention.

The fact that also in Embodiment 1 an elastic member 16 is not exteriorly disposed, fully contributes to miniaturization of a shuntless current-carrying mechanism. However, in order to generate a certain level of a contact pressure between a movable contact arm 8 and a movable contact arm support 11, the wire diameter and the winding number need to be taken into account, and a spacing between the movable contact arm 8 (Dimension D as shown in FIG. 2) should not be negligible. A case in which Dimension D is made as narrow as possible will be described as Embodiment 3. Here, FIG. 5 and FIG. 6 are views corresponding to FIG. 2 and FIG. 4 in Embodiment 3, respectively, and FIG. 7 is an outline perspective view of a helical spring employed in Embodiment 3.

Figure 5:
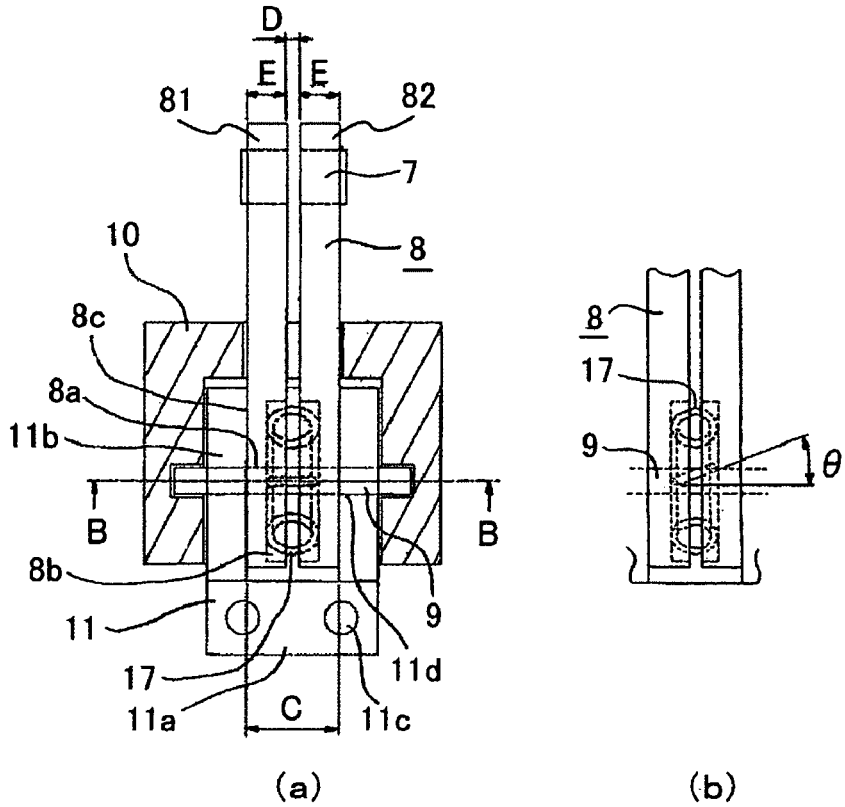
FIG. 5 is a cross-sectional view corresponding to FIG. 2 in Embodiment 3 of the present invention.

Referring to FIG. 5(*a*), recesses 8*b* are provided on lateral surfaces, of movable contact arm members 81 and 82 arranged in parallel, facing each other, i.e., on the opposite side of the surfaces that abut on the movable contact arm support 11. A helical spring 17 is fitted into the recesses 8*b*. It should be noted that in Embodiment 1, the movable contact arm members 81 and 82 are provided, but the quantity is not limited to two. The helical spring 17 is annularly formed by jointing, as illustrated in FIG. 7, both ends of a conventional compression spring together. Referring again to FIG. 5(*a*), the helical spring 17 can bias the movable contact arm members 81 and 82 in a direction that the contact areas 8*c* are made in contact with the respective lateral sides of connecting conductors 11*b*. Since the overall dimension of the movable contact arm 8 with the helical spring 17 sandwiched therebetween (corresponding to the total of Dimensions E, D and E as shown in FIG. 5*a*) is slightly larger than Dimension C, the helical spring 17 can easily bias the movable contact arm 8 in such a direction that the movable contact arm 8 is made tightly in contact with the connecting conductors 11*b*, thus facilitating insertion of the movable contact arm members 81 and 82 into the pair of connecting conductors 11*b*.

In FIG. 5(*a*), Dimension D becomes somewhat narrower compared with that prior to inserting into the movable contact arm support 11. The reduced dimension, in turn, is converted into an urging force that urges the connection areas 8*c* against the connecting conductors 11*b*. After this insertion, through-holes 8*a* and second through-holes 11*d* are aligned with each other, a shaft 9 is passed through these through-holes 11*d* and 8*a*, and then, as shown in FIG. 6, the shaft 9 is engaged into U-shaped (not shown) recesses in a crossbar 10. As is the case with Embodiment 1, a compression spring, not shown, is placed. Therefore, the helical spring 17 allows surface contact between the contact areas 8*c* of the movable contact arm 8 and the connecting conductors 11*b* to be maintained, so that stable contact resistance is ensured as is the case with Embodiment 1 as well as the shuntless mechanism itself can be miniaturized.

It should be noted that although, as is clear from FIG. 5(*a*), the helical spring 17 is formed so as to be nearly in parallel with the shaft 9, the helical spring 17 may be formed so that an angle of θ (theta), is imparted thereto with respect to the left and right directions of the shaft 9 on the drawing, as is shown in FIG. 5(*b*), in which case the urging force against the conductors 11*b*, via the contact areas 8*c* is further stabilized.

Embodiment 4

A helical spring 17 is applicable even when one thick movable contact arm 8 is used, as has been described in Embodiment 2. This will be described as Embodiment 4. Here, FIG. 8 is a view corresponding to FIG. 3 in Embodiment 4.

Figure 8:
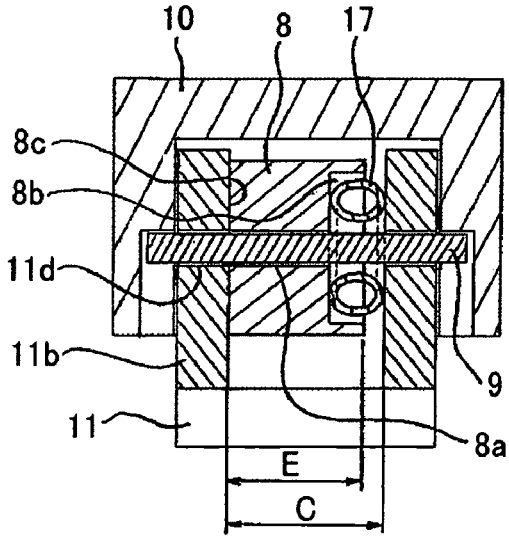
FIG. 8 is a cross-sectional view corresponding to FIG. 3 in Embodiment 4 of the present invention.

Referring to FIG. 8, provided on the opposite sides of contact areas 8*c* of a movable contact arm 8 are recesses 8*b*, into which the helical spring 17 is inserted. As is the case with Embodiment 3, the helical spring 17 being sandwiched applies a slight load to the spring, so that the contact areas 8*c* are pressed against connecting conductors 11*b*. Consequently, as is seen from FIG. 8, Dimension C between the connecting conductors 11*b* can only be made somewhat larger than thickness Dimension E of the movable contact arm 8, so that stable contact resistance as well as further miniaturized structure, or increased current-carrying capacity by thickening the movable contact arm 8 can be anticipated.

Embodiment 5

Figure 9:
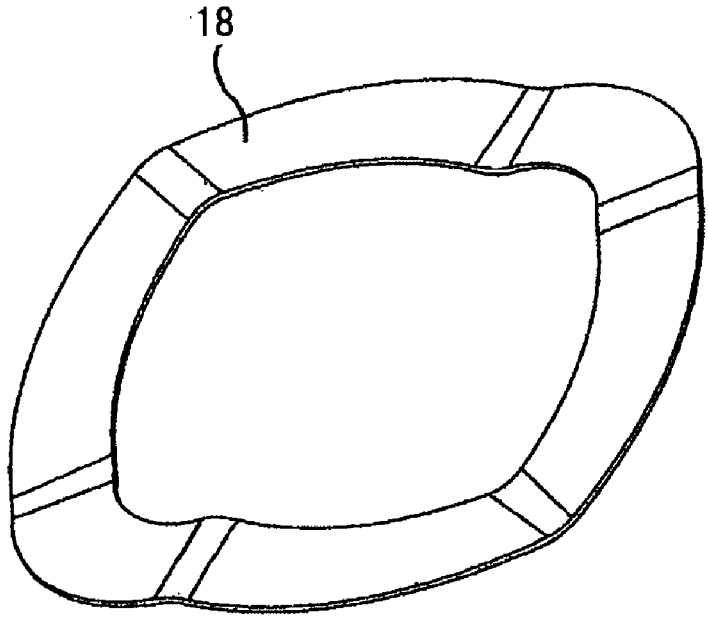
FIG. 9 is an external view of a wave spring in Embodiment 5 of the present invention.
Figure 9:
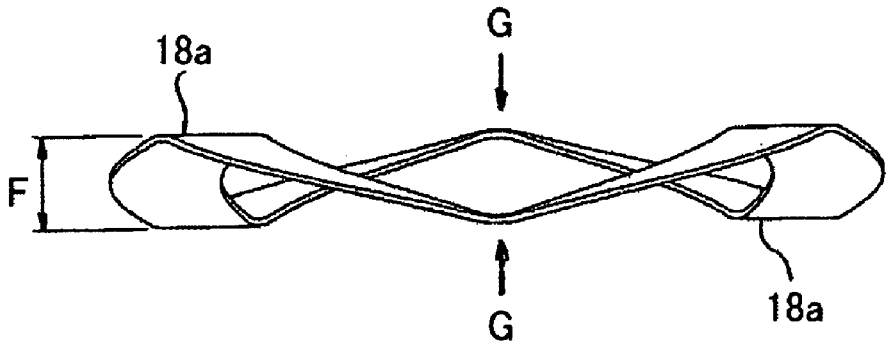

FIG. 9 is an external view of a wave-shaped material to be used in Embodiment 5; (a), a perspective view thereof, and (b), a side elevational view thereof. As has been described, an annularly-formed helical spring is used in Embodiments 3 and 4. An explanation will be made as Embodiment 5 in which a material as shown in FIG. 9 is fitted into recesses 8*b* of a movable contact arm 8 as has been shown in FIG. 6 or FIG. 8.

More specifically, as shown in FIG. 9(*b*), each of peaks 18*a* of the member (here assumed to be a wave spring 18) will make contact with the movable contact arm 8 only, or both movable contact arm 8 and movable contact arm support 11. Since Spacing D (refer to FIG. 6) created by inserting the movable contact arm 8 into the movable contact arm support 11 is narrower than Dimension F, the wave-spring 18 undergoes pressing force in the direction of Arrow G, whereby contact areas 8*c* are urged against connecting conductors 11*b*. Accordingly, stable contact resistance is ensured as well as a further miniaturized shuntless current-carrying mechanism can be implemented.

Embodiment 6

An explanation will be made as Embodiment 6 in which electrical conductivity is imparted to the helical spring 17 as has been used in Embodiment 2 and 4. Referring to FIG. 8, if a helical spring 17 is made of a conductive material, or of a material having a surface treated with a conducting substance, in addition to a current path of a movable contact arm 8, a movable contact arm support 11, and a relay conductor 14 (refer to FIG. 1), in that order, another current path in which the helical spring 17 serves as part of the path can be established. For this reason, contact resistance can be reduced. Furthermore, in FIG. 5, for instance, even if contact condition between movable contacts 7 in the right part of the drawing and a stationary contact 6, not shown, would by any possibility be worsened, via the helical spring 17 the current path of a left side movable contact arm member 81, a right side movable contact arm member 82, and the right side conductor of connecting conductors 11*b*, in that order, can be established, so that substantial increase of the resistance value can be prevented.

Embodiment 7

Figure 10:
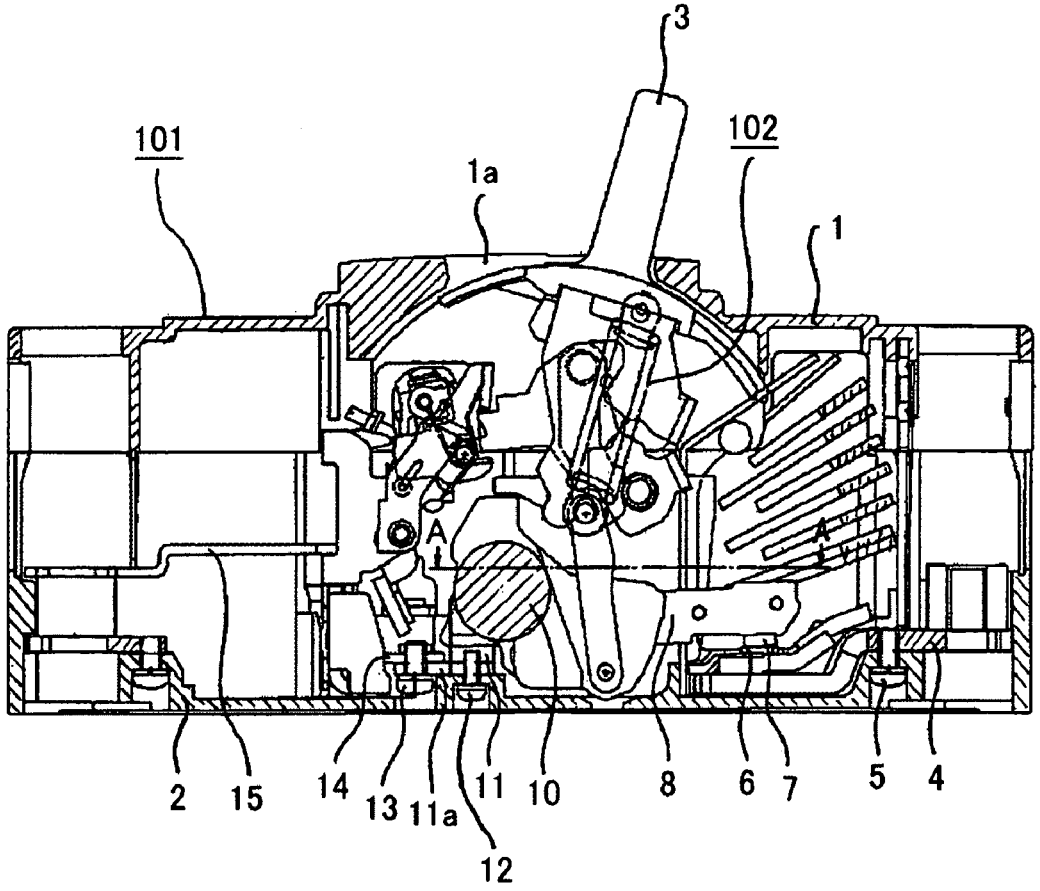
FIG. 10 is a sectional side elevation of the circuit breaker in Embodiment 7 of the present invention.
Figure 11:
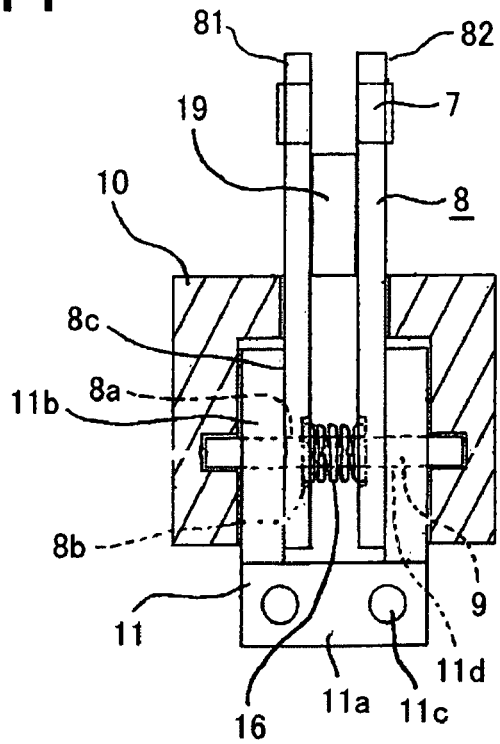
FIG. 11 is a fragmentary sectional view taken along Line A-A in FIG. 10.

FIG. 10 is a cross-sectional view of a circuit breaker in Embodiment 7 of the present invention: FIG. 11 being a cross-sectional view taken along Line A-A in FIG. 10.

Referring to FIG. 10, an enclosure 1 and a case base 2 constitute the case of a circuit breaker 101, each being formed of a synthetic resin material. The case base 2 houses an opening/closing mechanism 102, and an operating handle 3 that is cooperated with the opening/closing mechanism 102 protrudes outwardly from the enclosure 1, through an opening 1*a* for the operating handle. The operating handle 3 is made to be hand-operable from the outside thereof, as is well known in the art. It is also well known in the art that, from the position of the operating handle 3 of the circuit breaker 101 in the closed state, a terminal (not numerically referenced) to which e.g., a power source cable and a load cable are connected are present in the right and left sides of the figure, respectively.

In the above-described circuit breaker, a stationary contact arm 4 that constitutes the terminals for the power source cables is fixed to the case base 2 using a fixing screw 5; a stationary contact 6 fixed to one end of the contact arm 4 detaches from movable contacts 7 fixedly mounted on one end of a movable contact arm 8; thereby the opening/closing of the circuit breaker 102, i.e., switching-on/off of the electric circuit is performed. The movable contact arm 8 is pivotally supported via a movable contact arm support 11 by means of a shaft 9 as well as a crossbar that holds the movable contact arm 8 is linked with the opening/closing mechanism 102, so that the opening/closing operation is performed in response to the action of the opening/closing mechanism 102. Since the opening/closing operation constitutes no main part of the present invention, the detailed explanation will be omitted.

In the preceding explanation, the movable contact arm 8 is sandwiched between the connecting conductors 11*b* of the movable contact arm support 11. The movable contact arm support 11 is fixed to the case base 2 by means of a fixing screw 12 as well as to a relay conductor 14 by means of a fixing screw 13. The relay conductor 14 is connected, via a heater that constitutes an overcurrent release (not shown), with a load conductor 15 that constitutes a terminal for a load cable. Consequently, a current path in the closed condition is the stationary contact arm 4, the stationary contact 6, the movable contacts 7, the movable contact arm 8, the movable contact arm support 11, the relay conductor 14, the heater, and the load conductor 15, in that order. This shows that a shuntless current-carrying mechanism without using a shunt is configured. Focusing on the movable contact arm 8 and the movable contact arm support 11, an explanation will be made below.

Referring to FIG. 11, the movable contact arm support 11 is integrally formed with a base mount 11*a* including screw holes, not shown, into which the fore-mentioned fixing-screw 12 is threaded, and a first through-hole 11*c* through which the fixing screw 13 is passed; and a pair of connection conductors 11*b* perpendicularly rising from the base mount 11*a*, and whose fore-ends mutually oppose, including the second through-hole through which the shaft 9 is passed. As a material used for forming the movable contact arm support 11, a copper plate having good electrical conductivity is employed, and its shape and thickness is also considered so as not to easily undergo deformation. On the other hand, as described previously, the movable contacts 7 are fixedly mounted on one end of the movable contact arm 8, on the other end of which through-holes 8*a* is provided. By passing the shaft 9 through the through-holes 8*a*, the movable contact arm 8 is pivotally supported by the second through-holes 11*d*. It should be noted that a crossbar 10 holds both ends of the shaft 10 and grasps the movable contact arm 8 so that the movable contact arm 8 is designed to respond to the operation of the opening/closing mechanism 102.

As is clear from FIG. 11, the movable contact arm 8 aims at applications to middle- or large-sized circuit breakers by arranging in parallel two movable contact arm members 81 and 82. Recesses 8*b* are provided in each portion of the through-holes 8*a* on the opposing lateral surfaces of the movable contact arm members 81 and 82 arranged in parallel, i.e., on both inner lateral surfaces that are the opposite sides of the surfaces of the movable contact arm members 81 and 82 that make contact with the movable contact arm support 11. Both ends of an elastic member 16 loosely mounted on the shaft 9 are fitted into the counterbore 8*b*. It should be noted that various types of springs could be used as the elastic member 16, which, as illustrated in the figure uses, as an example, a spiral spring. By the elastic member 16 sandwiched between the movable contact arm members 81 and 82 arranged in parallel, contact areas 8*c* of the movable contact arm 8 is urged against the conductors 11*b*, thus ensuring surface contact between them. This surface contact stabilizes electrical contact between the movable contact arm 8 and the movable contact arm support 11. In addition, the connecting conductors 11*b* do not need to be bent, so that they can be thickened, thus allowing for the current-carrying capacity for the middle- or large-sized circuit breakers. An embodiment in which a spiral spring is used as the elastic member 16 has been shown. When a spacing between a pair of movable contacts arm members arranged in parallel is made narrower, an annular spring formed by connecting together each end of a flat-strip spring, or each end of a spiral spring having a small diameter, is suitable for use.

As has been described previously, the movable contact arm 8 is configured by arranging in parallel the two movable contact arm members 81 and 82. As is indicated in Patent Document 1, therefore, when a high current flows, attraction force due to electromagnetic force is produced between the movable contact arm members 81 and 82. In the movable contact arm 8, the movable contact arm members 81 and 82 needs to be prevented from contacting each other due to the attraction force between them. For this reason, in the present invention, as shown in FIG. 11, an anti-attraction member 19 has been fixed to either of the opposing lateral side of the movable contact arm members 81 and 82, by means of rivets, adhesives, or the like. Although a synthetic resin material such as nylon is suited to the anti-attraction member 19, the member 19 can also be formed of a metal material as well. In this way, coupled with the member 19 making surface contact with the movable contact arm 8, stable contact between the movable contact arm 8 and the movable contact arm support 11 can be ensured when a high current flows therethrough, thereby preventing beforehand welding due to arcing between both parts from occurring.

To sum up, in the movable contacting device of the present invention, because, between the movable contact arm members 81 and 82 arranged in parallel, the elastic member 16 is sandwiched between their shaft supporting portions as well as the anti-attraction material is sandwiched at the intermediary point between the movable contact and the shaft supporting portions, a shuntless current-carrying mechanism that is free from welding due to arcing as well as miniaturized in size can be made available. Furthermore, this configuration can improve the opening/closing lifetime of middle- or large-sized circuit breakers.

Embodiment 8

Figure 12:
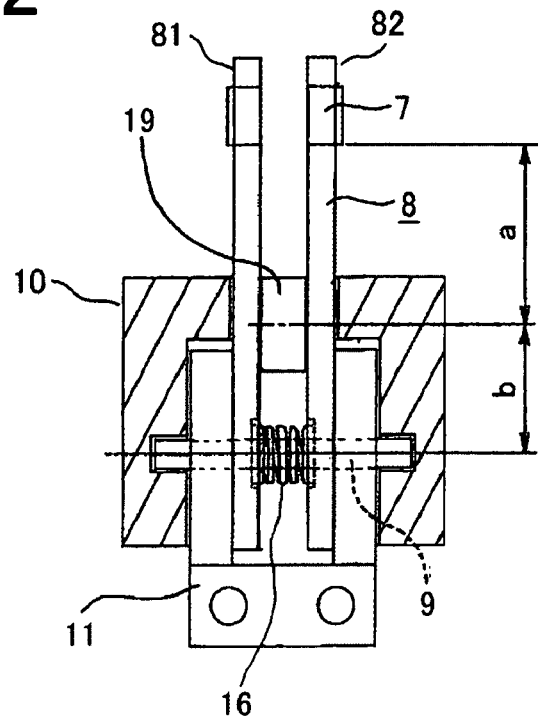
FIG. 12 is a fragmentary cross-sectional view corresponding to FIG. 11 in Embodiment 8 of the present invention.

FIG. 12 is a view corresponding to FIG. 11 in Embodiment 8 of the present invention. In FIG. 12, an anti-attraction member 19 is firmly sandwiched at a position closer to a shaft 9 than the intermediary point between movable contacts 7 and the shaft 9. That is, Dimension a from movable contacts 7 to the anti-attraction member 19 has been made larger than Dimension b from the anti-attraction member 19 to the shaft 9. When a high current flows therethrough, such configuration will help attraction force act more strongly on the contact side than the shaft 9 side. Accordingly, with the member 19 serving as a fulcrum, the attraction force acts so as to widen a spacing on the shaft 9 side, between movable contact arm members 81 and 82. Since this action functions to urge a movable contact arm 8 against a movable contact arm support 11, an electrical contact state between the movable contact arm 8 and the movable contact arm support 11 becomes further stabilized.

Embodiment 9

Figure 13:
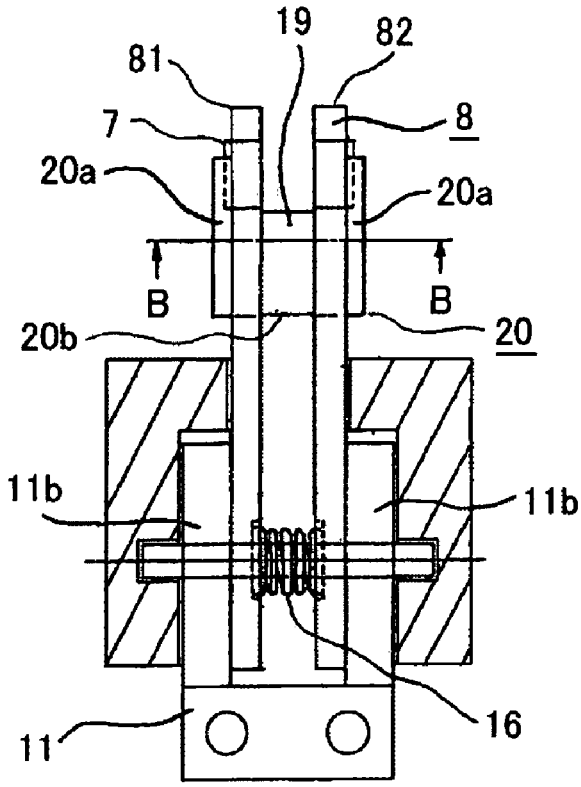
FIG. 13 is a fragmentary cross-sectional view corresponding to FIG. 11 in Embodiment 9 of the present invention.
Figure 14:
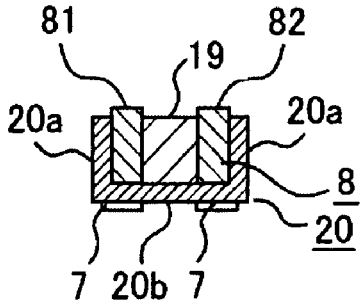
FIG. 14 is a fragmentary cross-sectional view taken along Line B-B in FIG. 13.

FIG. 13 is a view corresponding to FIG. 11 in Embodiment 9 of the present invention, and FIG. 14 is a cross-sectional view taken along Line B-B in FIG. 13. In FIG. 13, within surfaces that make contact with both exterior lateral sides of a movable contact arm 8, i.e., that make contact with both inner opposing sides of connecting conductors 11*b*, an anti-vibration sub-member 20*a* is abutted on both exterior lateral sides of surface portions between which an anti-attraction member 19 is sandwiched. Along with this arrangement, as illustrated in FIG. 14, an anti-vibration member 20 is formed on a movable contact side, by connecting both exterior lateral sides of the anti-vibration sub-member 20*a* with a connecting sub-member 20*b*. Furthermore, the anti-vibration member 20 and the anti-attraction member 19 are integrally united as illustrated in FIG. 14. In this case, the anti-vibration member 20 and the anti-attraction member 19 may be formed of different parts, and formation by a synthetic resin material would allow both anti-vibration member 20 and anti-attraction member 19 to be integrally molded. When a circuit breaker undergoes vibration or an impact, the movable contact arm 8 may in some cases exhibit such behavior that it opens outwardly. By providing the member 20 as well as the member 19, as is discussed above, its behavior due to the vibration and impact can be curbed. Therefore, the electrical contact condition between the movable contact arm 8 and a movable contact arm support 11 is further stabilized.

Embodiment 10

Figure 15:
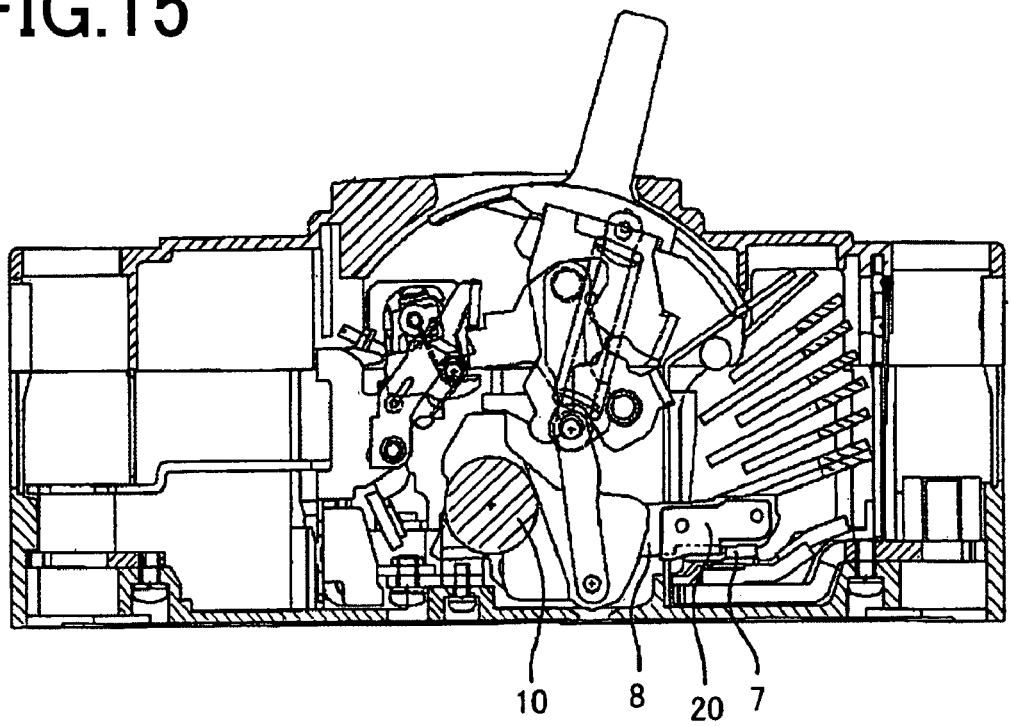
FIG. 15 is a cross-sectional view corresponding to FIG. 10 in Embodiment 10 of the present invention.
Figure 16:
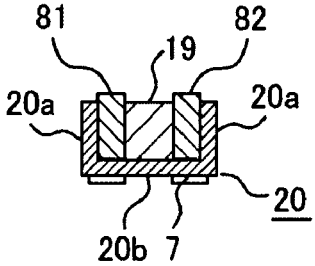
FIG. 16 is a fragmentary cross-sectional view corresponding to FIG. 14 in Embodiment 10 of the present invention.

FIG. 15 and FIG. 16 are views corresponding to FIG. 10 and FIG. 14 in Embodiment 10 of the present invention, respectively. Referring to FIG. 15, an arc insulating member (an anti-vibration member 20 as described later) that prevents arcing from traveling toward a crossbar 10 side, and emits gas for leading the arcing toward the power source side, when overcurrent is interrupted, is fixed in the proximity of movable contacts 7 of both lateral surfaces of a movable contact arm 8. FIG. 15 is the same as FIG. 10 except the arc insulating member being fixed.

Referring to FIG. 16, the above-mentioned arc-insulating member is fixedly mounted on the movable contact arm 8 so as to hold the both surfaces of the movable contact arm 8. That is, a feature of Embodiment 10 is that an arc insulating function is imparted to the anti-vibration member 20, as has been explained in Embodiment 9 (FIG. 14). In order to impart the arc insulation function, polyethylene-terephtalate, nylon66, and nylon46 and the similar are suitable for materials for the anti-vibration member 20, as is indicated in Japan Patent Publication 3359422 as materials for arc-extinguishing insulating material compositions and arc-extinguishing insulating material molding. It should be noted that when the anti-vibration member 20 and an anti-attraction member 19 are combined into one, such materials may be used to integrally form the anti-vibration member 20 and the anti-attraction member 19. According to Embodiment 10, the movable contact arm 8 and a movable contact arm support 11 make stable contact with each other. In addition, the interrupting performance is enhanced by arc-extinguishing gas to be emitted from the arc insulating member when the arc-insulating member is exposed to the arc.

Embodiment 11

Figure 17:
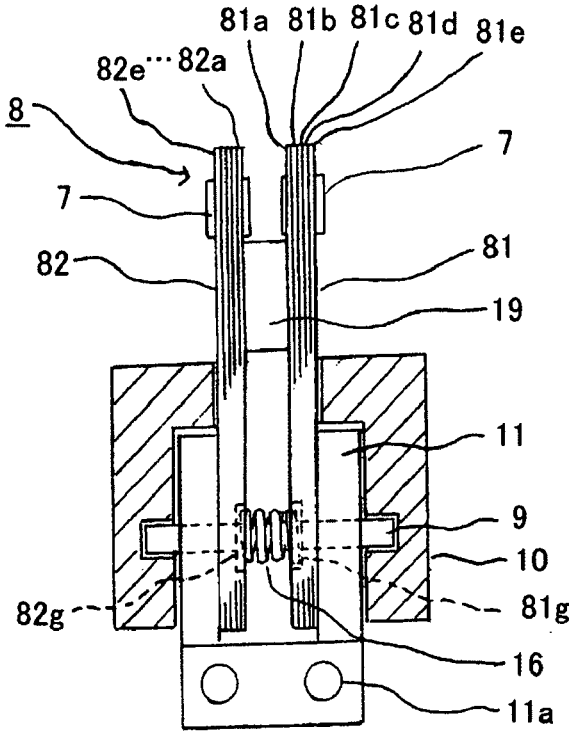
FIG. 17 is an explanatory diagram illustrating a pole of a movable contact that is to be a major portion of the present invention.

FIG. 17 is an explanatory schematic diagram illustrating a movable contact arm for one pole—the main part of the invention—in a circuit breaker that relates to the present invention. Referring to FIG. 17, reference numeral 8 denotes a movable contact arm that is configured by arranging in parallel two movable contact arm members 81 and 82 as well as each end of the contact arm members is made to be pivotally supported. Reference numeral 7 denotes a well-known movable contact, provided on each end of the movable contact arm members 81 and 82, that opens and closes the electric circuit in combination with a stationary contact (not shown) provided on the bottom of a case. Reference numeral 19 denotes an anti-attraction member maintaining a spacing between the movable contact arm members 81 and 82, and restrains them from being attracted by electromagnetic force when a high current flows through the arm members. Reference numeral 11 denotes a current-carrying movable contact arm support formed of copper sheet metal, which pivotally supports the other end of the movable contact arm 8 by means of a shaft 9, and simultaneously sandwiches the outer lateral side surfaces of the contact arms 8. The movable contact arm support 11 is screw-secured to the bottom of the case (not shown), via through-holes 11*a*. Reference numeral 16 denotes an elastic member, which is abuttedly sandwiched between the inner lateral sides of shaft support portions of the movable contact arm 8, and biased so as to urge the above-mentioned two movable contact arm members 81 and 82 against the movable contact arm support 11. This biasing establishes electrical contact between the outer lateral sides of the movable contact arm 8 and the movable contact arm support 11. Here, reference numerals 81*g* and 82*g* denote recesses for sandwiching the elastic member therebetween. Reference numeral 10 denotes a well known crossbar, as shown in a sectional view, that is linked with an opening/closing mechanism (not shown) whose operation opens or closes the movable contact arm 8. Since the crossbar 10 does not constitute the main part of the present invention, detailed description thereon will be omitted.

Figure 18:
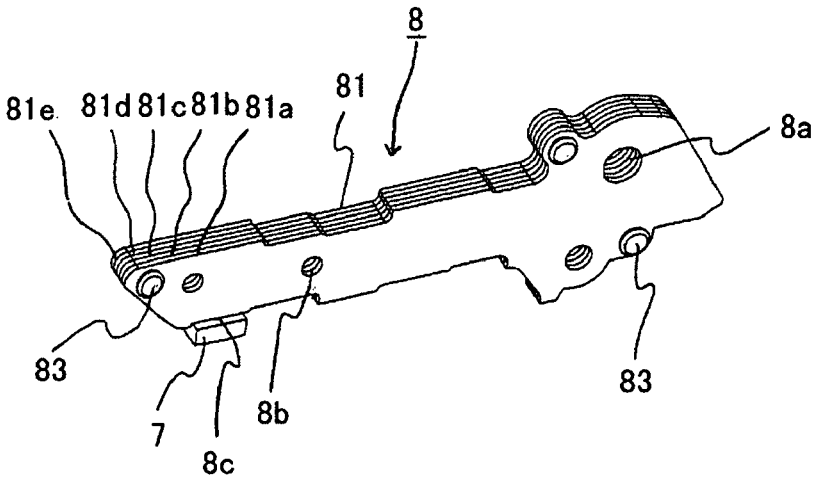
FIG. 18 is an oblique perspective view of one piece of the movable contact member in Embodiment 11 of the present invention.

FIG. 18, which illustrates Embodiment 11 that relates to the main part of the present invention, is a perspective view of the movable contact arm members 81 and 82. (In a case of FIG. 8, the movable contact arm member 81 is shown.) In FIG. 18, the movable contact arm member 81 will have the same thickness as that of, e.g., an arm member (reference numeral 6) as shown in, for example, FIG. 1 of Patent Document 2, by laminating a plurality of segments 81*a* through 81*e* formed of identically-shaped copper sheet metal, and fixing the segments 81*a* through 81*e* at a plurality of places (three places in this embodiment) by means of rivets 83. Lamination of the segments 81*a* through 81*e*, which varies according to the current ratings of circuit breakers, are formed typically by laminating several pieces of copper sheet metals each having a thickness of 1 mm through 2 mm. In addition, depending on the current ratings, the copper sheet metal may be substituted with a sheet metal material of a copper alloy having high electrical conductivity. The movable contact arm member 82, as is not illustrated, is also formed in the same way.

As described above, through-holes 8*a* for passing through the shaft about which the movable contact arm 8 pivots, and a hole for installing a means for driving an arc generated when overcurrent is interrupted, e.g., a hole 8*b* for placing an insulative synthetic resin material as shown in Japanese Patent Publication 3359422 is obtained concurrently with manufacture of the segments 81*a* through 81*e*, so that manufacturing costs of the movable contact arm 8 themselves can be reduced. Movable contacts 7 are fixed to laminated segments 81*a* through 81*e* by brazing, etc. In order to enhance current carrying performance, it is preferable that they be fixed after having evenly shaved contact areas 8*c*. Furthermore, an embodiment in which a spiral spring is used as an elastic member 16 has been shown. When a spacing between the movable contact arm members 81 and 82 arranged in parallel is made narrower for the sake of miniaturization, it is suitable to use a spring formed annularly by connecting together each end of a flat-strip spring, or each end of a spiral spring of a small diameter. It should be noted that recesses 81*g* and 82*g* can be easily formed by enlarging the through-holes 8*a* for passing through the shaft, of one segment: the inner-most segment 81*a*.

Embodiment 12

Figure 19:
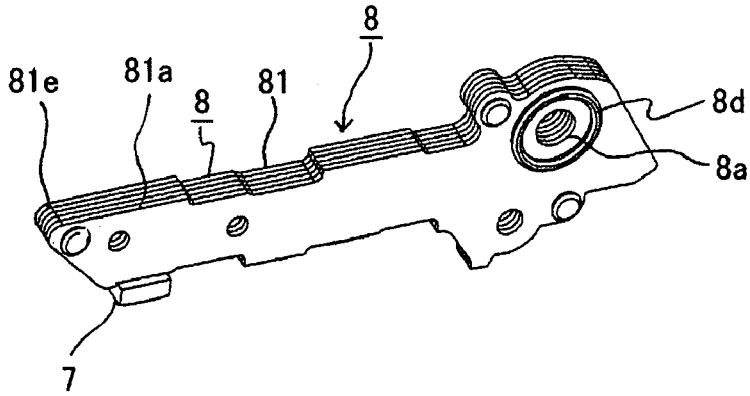
FIG. 19 is an oblique perspective view of one piece of the movable contact member in Embodiment 12 of the present invention.

A movable contact arm having a complicated shape, including Embodiment 13 and 14 as is to be described later, will be described. FIG. 19 is a perspective view illustrating a movable contact arm member in Embodiment 12 of the present invention, which corresponds to FIG. 18 in Embodiment 11. As has been described in Embodiment 11, a movable contact arm 8 configured by two movable contact arm members 81 and 82 are pivotally supported by a movable contact arm support 11 as well as their outer lateral sides are sandwiched, wherein an elastic member 16 is inserted between the movable contact arm members 81 and 82 so that electrical contact is established between the movable contact arm 8 and the movable contact arm support 11. In such a configuration, however, electromagnetic attractive force generated when an overcurrent flows, inwardly draws the movable contact arm members 81 and 82 toward each other. A possible approach to this, as illustrated in FIG. 17, is to provide an anti-attraction member 3, however, because of such matters as mounting the elastic member 16 on a shaft 9 portion, the anti-attraction member may in some cases be difficult to place. Consequently, on the electrically contacted portions, the movable contact arm members 81 and 82 are attracted inwardly each other, thereby arcing could occur between the movable contact arm support 11 and each of the movable contact arm members 81 and 82.

Thus, as shown in FIG. 19, if a spacing protrusion 8*d* is provided only on each of inner-most segments 81*a* and 82*a*, of the movable contact arm members 81 and 82, respectively, so that the protrusions face each other, the protrusions serve as a stopper, thus curbing inward attraction of the movable contact arm 8. It should be noted that as long as the spacing protrusion 8*d* equals to the spacing between the movable contact arm members 81 and 82, either one of the segments, e.g., the segment 81*a* may be provided with the protrusion.

Embodiment 13

Figure 20:
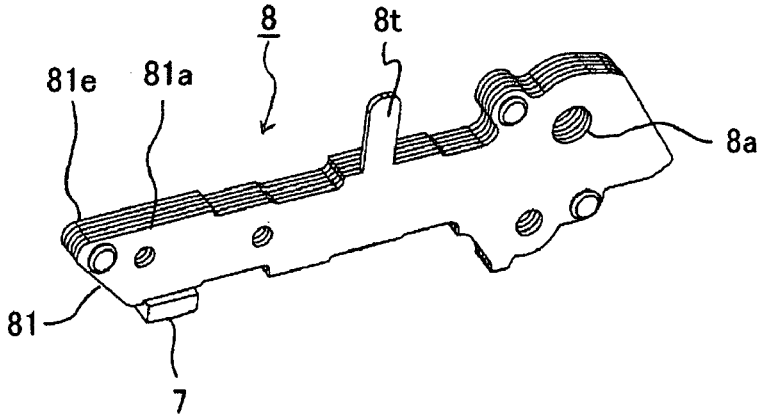
FIG. 20 is an oblique perspective view of one piece of the movable contact member in Embodiment 13 of the present invention.

FIG. 20 illustrates Embodiment 13 of the present invention, and is a view corresponding to FIG. 18 in Embodiment 11. A circuit breaker may in some cases have a built-in auxiliary device for signaling out the open/closed state, i.e., an opening/closing position of a movable contact arm 8. A microswitch is used for the auxiliary device that transfers to the actuator of the microswitch, motion of the movable contact arm 8. (e.g., refer to FIG. 1 of the circuit breaker shown in Japanese Patent Publication H9-306328) Consequently, the movable contact arm 8 needs a portion to engage with the actuator, and the engaging portion does not depend upon the degree of the current rating. That is, even though, in large-sized circuit breakers, the movable contact arm 8 is large in volume, the auxiliary device is configured with the microswitch, thereby enabling the engaging portion itself to be made comparatively small.

Thus, as shown in FIG. 20, if an engaging protrusion 8*t* for engaging with the actuator is provided on only any one of segments 81*a* through 81*e* of a movable contact arm member 81, the movable contact arm member 81 is adaptable to the auxiliary device. Therefore, in comparison with a case where by another process an additional protrusion is added to a conventional movable contact of one piece structure, having a thickness equal to that of the movable contact arm 8, manufacturing becomes easier, and manufacturing costs can resultantly be anticipated to be reduced. It should be noted that in the preceding description, although an embodiment has been demonstrated in which the segments 81*a* through 81*e* of the movable contact arm member 81 are provided with the engaging protrusion 8*t*, a movable contact arm member 82 can be provided with the protrusion 8*t* as well.

Embodiment 14

Figure 21:
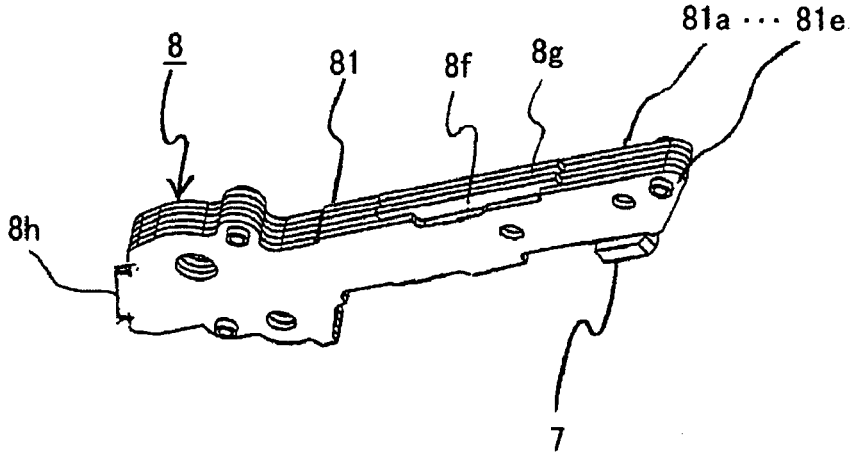
FIG. 21 is an oblique perspective view of one piece of the movable contact member in Embodiment 14 of the present invention.

FIG. 21 illustrates Embodiment 14 of the present invention, and is a view corresponding to FIG. 18 in Embodiment 11. Referring to FIG. 21, neighboring segments out of segments 81*a* through 81*e* forming a movable contact arm member 81 have heat radiating outer edge asperity structures 8*f*, 8*g* and 8*h* in mutually differing position. In portions where an influence on the density of a current flowing in the movable contact arm member 81 is slight, the heat radiating asperity structures are formed in a size that minimizes the influence. In the embodiment as shown in the figure, some of the segments 81*a* through 81*e* are provided with the heat radiating asperity structures 8*f* through 81*h*, however, so can the whole of the segments as well. This configuration allows surface areas of the segments 81*a* through 81*e* to be easily increased, thus resulting in a low-cost contact arm having high heat radiation efficiency.

It should be noted that Embodiment 12, 13 and 14 will increase kinds of segments, however, circuit breakers are mass-produced, and one circuit breaker is typically equipped with movable contact arms for three poles, so that there is little effect on manufacturing costs due to increased kinds of segments. As thus far described in Embodiments 12 through 14, configuring a movable contact arm 8 by laminating segments of copper metal sheets brings about the expectation that a configuration of the movable contact arm 8, depending on its application can be achieved at lower processing cost.

Embodiment 15

Figure 22:
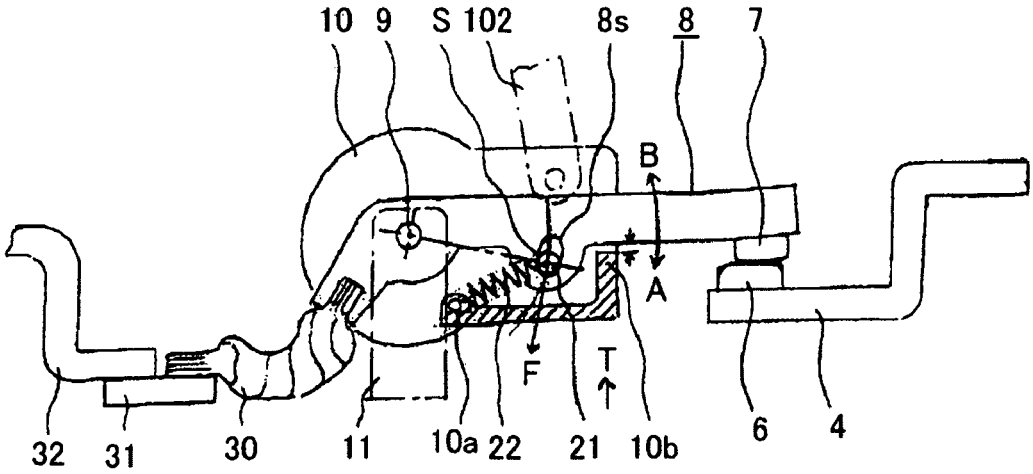
FIG. 22 is a front elevational view illustrating a configuration of one pole of the movable contact of the circuit breaker in Embodiment 15 of the present invention.
Figure 23:
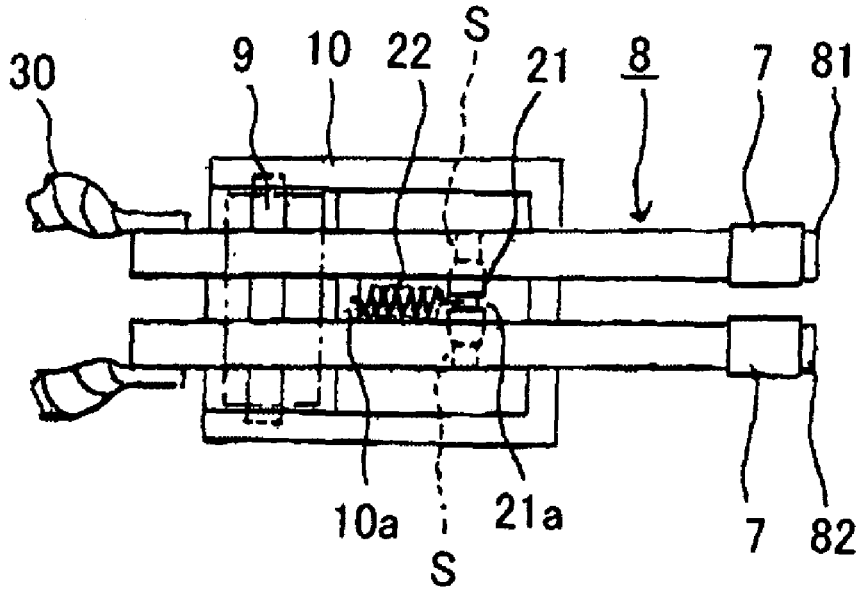
FIG. 23 is a plan view viewed from Arrow A direction in FIG. 22.
Figure 24:
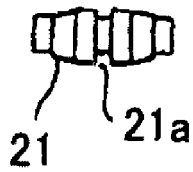
FIG. 24 is a parts diagram of a spring anchor in FIG. 22.

FIGS. 22 and 23 are simplified diagram illustrating the main part of a circuit breaker in Embodiment 15 of the present invention. FIG. 22 is a front elevation for explaining the structure of a movable contact arm for one pole, and FIG. 23 is a bottom plan as viewed from the direction of Arrow Tin FIG. 22. Furthermore, FIG. 24 is a parts diagram of a spring anchor member in FIGS. 22 and 23.

As shown in FIG. 22, movable contacts 7 that repeat touching on and detaching from a stationary contact 6 fixedly mounted on one end of a stationary contact arm 4, is fixedly mounted on one end of a movable contact arm 8. The movable contact arm 8 is pivotally supported by a shaft 9 at the other end, via a movable contact arm support 11 (indicated by dashed-dotted lines) fixed to a case base (not shown). The movable contact arm 8 is configured, as shown in FIG. 23, by arranging in parallel two (a pair of) flat strips of movable contact arm members 81 and 82 and fixedly mounting the movable contacts 7 on each of the movable contact arm members 81 and 82. Reference numeral 10 denotes a crossbar well known in the art, that integrally links with a multi-pole movable contact arm 8 in order to open/close the multi-pole movable contact arm 8 by means of one opening/closing mechanism 102. Its opening/closing operation and detailed mechanism and the like will be described later. Reference numeral 30 denotes a flexible wire that warps according to pivotal movement of the movable contact arm 8; reference numeral 31 denotes a relay conductor that connects the flexible wire 30 with a bimetal strip 32, where those three items are well known in the art and do not constitute the main part of the present invention, therefore, their detailed explanation will be omitted. It should be noted that in this embodiment, explanations will be made as a mechanism using the flexible cable 30, i.e., a shunt mechanism, however, a mechanism without using the flexible cable 30, so-called a shuntless mechanism may be used.

In the configuration described above, a pair of the movable contact arm members 81 and 82 of the movable contact arm 8 is provided with mutually opposing elongate holes 8*s*, at the intermediary point between the movable contacts 7 and the shaft 9, and these elongate holes 8*s* are spanned with a spring anchor member 21. At the place where the center of the spring anchor member 21 and the center of the spacing between the two movable contact arm members 81 and 82 substantially coincide with each other, the spring anchor member 21 is provided with a recess-shaped spring anchor portion 21*a*. Moreover, a crossbar 10 is provided with a second spring anchor portion 10*a* at a place opposite to a first spring anchor portion 21*a* formed on the spring anchor member 21, that is, at a place, as with the first anchor portion 21*a*, corresponding to the intermediary point between the movable contact arm members 81 and 82. A contact pressure extension spring 22 is extended between the second anchor portion 10*a* and the first anchor portion 21*a*.

In the configuration described above, it is preferable that the first anchor portion 21*a* of the spring anchor member 21 be placed substantially in the middle between the movable contact arm members 81 and 82 in order to prevent spring performance from being worsened or lost due to the contact pressure extension spring 22 being exposed to arcing generated when overcurrent is interrupted. With the above arrangement, the extension spring 22 is extended along the intermediary points between the pair of movable contact arm members 81 and 82. With this configuration, the acting force F from a point of action situated on a tangential line to a circle whose radius equals to a distance between the shaft 9 and the spring anchor member 21 (refer to FIG. 22) will serve as the contact pressure. In other words, the biasing force from the contact pressure extension spring 22 located substantially in the middle between two points of action S (refer to FIG. 23 as well) is transferred via the spring anchor member 21 to the points of action S on the pair of the movable contact arm members 81 and 82, so as to act in the direction in which the movable contacts 7 are urged against the stationary contact 6.

Next, the relationship between the above-described contact pressure extension spring 22, and the opening/closing operation and mechanism of the crossbar 10, as stated earlier as "will be described later" will be explained. As is well known in the art, the crossbar 10 is made to be rotatable on the shaft 9, integrally with the movable contact arm 8. In this case, the contact pressure extension spring 22 is stretched between the movable contact arm 8 and the crossbar portion, so that the movable contact arm 8 are urged constantly in the direction of Arrow A. Thus, while the movable contacts 7 of the movable contact arm 8 is separated from the stationary contact 6 of the stationary contact arm 4, the movable contact arm 8 is continuously abuttedly locked by a lock 10*b* of the crossbar 10. When by the opening/closing mechanism 102 the movable contacts 7 of the movable contact arm 8 is made contact with the stationary contact 6 of the stationary contact arm 4, after the movable contacts 7 and the stationary contact 6 have made contact with each other, the crossbar 10 is further pivotally moved in the direction of Arrow A. The pivotal movement separates the movable contact arm 8, as shown as Dimension C, from the lock 10*b* of the crossbar 10. When a spacing of Dimension C is created, acting force from the contact pressure extension spring 22 will serve as contact pressure between the movable contacts 7 and the stationary contact 6.

The above-mentioned crossbar 10 is configured so that when electromagnetic reacting force due to a high current flow are produced between the movable contact arm 8 and the stationary contact arm 4, the movable contact arm 8 can, regardless of the opening/closing mechanism 102, be pivotally supported freely in the direction of Arrow B, which is a well-known configuration as the crossbar 10. It should be noted that in the crossbar 10, the multi-pole movable contact arm 8 typically utilizes integrally formed synthetic resin material, however, even though the crossbar would be configured by forming, on a per-movable-contact-arm-8 basis, portions that engage with the movable contact arm 8, using synthetic resin materials or sheet metal materials, and by linking the portions with an insulating-materials-formed link-shaft, the configuration according to the present invention can be implemented.

The contact pressure extension spring 22 serves as described above, whereas, as is clear from FIG. 22, the elongate holes 8*s* are extended in the direction opposite to that of the acting force F This means that even though imbalance between the pair of movable contact arm members 81 and 82 would be created because of wear of the movable contacts 7 or the stationary contact 6 due to overcurrent interruption and the like, the acting force F can be transferred to each of the movable contact arm members 81 and 82 while the spring anchor member 21 is being slanted. Accordingly, even though one contact pressure extension spring 22 is used for the two movable contact arm members 81 and 82, current-carrying performance will not be halved, whereby low-cost and miniaturized configuration creating stable contact pressure can be achieved.

Furthermore, as shown in FIG. 24, provided in the middle of the spring anchor member 21 is a recess as a first spring anchor portion 21*a*. By hooking the extension spring 22 onto the recess-shaped first spring anchor portion 21*a*, even if the spring anchor member 21 would be slanted, the extension spring 22 constantly tends to remain in the midpoint in the longitudinal direction of the pair of the movable contact arm members 81 and 82, thereby further ensuring that the acting force F is transferred to the movable contact arm 8. It should be understood that when handling a higher current rating requires four movable contact arms, two sets of the pair of the movable contact arm members, as has been described in the present invention, will suffice. As thus far described, even though imbalance of the movable contact arm members would be created by wear of the contacts, normal current-carrying performance is ensured, whereby low-cost and miniaturized circuit breakers can be made available.

INDUSTRIAL APPLICABILITY

The present invention is applicable to circuit breakers such as molded-case circuit breakers and earth-leakage circuit breakers.

What is claimed is:

1. A circuit breaker comprising an opening/closing mechanism and a movable contacting device, each being accommodated in an insulative case, wherein the movable contacting device comprises:

a crossbar linked with the opening/closing mechanism and carried to pivot cooperatively with the opening/closing mechanism;

a movable contact arm engaged, to be cooperational with the crossbar, with a shaft fitted into mutually opposing recesses in the crossbar; and a movable contact arm support fixed to the insulative case accommodating the opening/closing mechanism and having mutually opposing through-holes through which the shaft is passed;

wherein the movable contact arm is configured so that the movable contact arm slides between surfaces of the movable contact arm support having the mutually opposing through-holes, a single-pole portion of the movable contact arm comprises two movable contact arm members arranged in parallel and each having a movable contact at one end, and a shaft-supporting portion at other end, in which an elastic member is sandwiched between the movable contact arm members, and an anti-attraction member is sandwiched between portions of the movable contact arm members, closer to the shaft than a middle point between the movable contacts and the shaft.

2. The circuit breaker as recited in claim 1, wherein each movable contact arm member of the movable contact arm is formed by laminating a plurality of segments made of an electrical conductive material.

3. The circuit breaker as recited in claim 2, wherein at least one of inner-lateral side segments of the two movable contact arm members is provided with a spacing protrusion for maintaining at a predetermined dimension a spacing between the two movable contact arm members.

4. The circuit breaker as recited in claim 2, wherein at least one of the plurality of the segments that forms each movable contact arm member is provided with an engaging protrusion that engages with an actuator.

5. The circuit breaker as recited in claim 2, wherein neighboring ones of the segments forming the movable contact arm member have heat radiating outer edge asperity structures in mutually differing positions.

6. The circuit breaker as recited in claim 1, wherein the surfaces of the movable contact arm support, between which the movable contact arm slides, are opposite one another.

7. The circuit breaker as recited in claim 1, wherein the shaft-supporting portions are disposed proximate the shaft and opposite the one end at which the contacts are disposed and the elastic member is sandwiched between the shaft-supporting portions.

8. The circuit breaker as recited in claim 7, wherein each movable contact arm member further includes an opening disposed in the shaft-supporting portion through which the shaft is inserted into the through-holes of the movable contact arm support and fitted into the recesses of the crossbar.

9. The circuit breaker as recited in claim 7, wherein the portion of each movable contact arm member includes a recess, into which the elastic member is fitted.

10. A circuit breaker comprising an opening/closing mechanism and a movable contacting device, each being accommodated in an insulative case, wherein the movable contacting device comprises:

a crossbar linked with the opening/closing mechanism and carried to pivot cooperatively with the opening/closing mechanism;

a movable contact arm engaged, to be cooperational with the crossbar, with a shaft fitted into mutually opposing recesses in the crossbar; and a movable contact arm support fixed to the insulative case accommodating the opening/closing mechanism and having mutually opposing through-holes through which the shaft is passed;

wherein the movable contact arm is configured so that the movable contact arm slides between surfaces of the movable contact arm support having the mutually opposing through-holes, a single-pole portion of the movable contact arm comprises two movable contact arm members arranged in parallel and each having a movable contact at one end, and a shaft-supporting portion at other end, in which an elastic member is sandwiched between the movable contact arm members, and an anti-attraction member is sandwiched between the movable contact arm members in an intermediate area between the movable contacts and the shaft and integrally comprises an anti-vibration member comprising:

a pair of anti-vibration portions abutting outer lateral surfaces of the movable contact arm alongside the movable contacts; and a connecting portion which connects the anti-vibration portions.

11. A circuit breaker comprising an opening/closing mechanism and a movable contacting device, each being accommodated in an insulative case, wherein the movable contacting device comprises:

a crossbar linked with the opening/closing mechanism and carried to pivot cooperatively with the opening/closing mechanism;

a movable contact arm engaged, to be cooperational with the crossbar, with a shaft fitted into mutually opposing recesses in the crossbar; and a movable contact arm support fixed to the insulative case accommodating the opening/closing mechanism and having mutually opposing through-holes through which the shaft is passed;

wherein the movable contact arm is configured so that the movable contact arm slides between surfaces of the movable contact arm support having the mutually opposing through-holes, a single-pole portion of the movable contact arm comprises two movable contact arm members arranged in parallel and each having a movable contact at one end, and a shaft-supporting portion at other end, in which an elastic member is sandwiched between the movable contact arm members, and an anti-attraction member is sandwiched between the movable contact arm members in an intermediate area between the movable contacts and the shaft and integrally comprises an anti-vibration member comprising:

a pair of anti-vibration portions abutting outer lateral surfaces of the movable contact arms; and a connecting portion which connects the anti-vibration portions, wherein the anti-vibration member comprises a material that generates an arc-extinguishing gas on exposure to electric arcing created when current flowing in the circuit breaker is interrupted.

* * * * *